United States Patent [19]

Gobbi

[11] Patent Number: 4,476,597

[45] Date of Patent: Oct. 16, 1984

[54] MOUNTAINEERING IMPLEMENT

[75] Inventor: Gioacchino Gobbi, Courmayeur, Italy

[73] Assignee: Grivel S.r.l., Courmayeur, Italy

[21] Appl. No.: 424,917

[22] Filed: Sep. 27, 1982

[30] Foreign Application Priority Data

Oct. 2, 1981 [IT] Italy ..... 68276 A/81

[51] Int. Cl.[3] ..... B25F 1/00

[52] U.S. Cl. ..... 7/159; 7/104; 7/170; 30/164.5; 30/339

[58] Field of Search ..... 30/339, 337, 334, 164.5; 7/114, 143–145, 138, 139, 148, 161, 104, 170; 125/40, 43; 172/375; 403/408; 145/3; 81/125.1

[56] References Cited

FOREIGN PATENT DOCUMENTS 462935 7/1928 Fed. Rep. of Germany ..... 125/43

536101 4/1922 France ..... 403/408

*Primary Examiner*—E. R. Kozenske

*Assistant Examiner*—Douglas D. Watts

*Attorney, Agent, or Firm*—Norbert P. Holler

[57] ABSTRACT

A mountaineering implement comprises a handle (1), a toolhead (3) mounted at one end (2) of the handle (1) and at least one tool (4, 5) releasably fixed to the toolhead (3). The toolhead has a slot (8) and the tool has a plate-like appendage (18, 26) slidably inserted and locked within this slot. Two opposing flat faces of the slot each have at least one rib (10) extending parallel to the direction of sliding of the plate-like appendage (18, 26) in the slot and each of these ribs (10) is engaged in a corresponding groove (20, 28) formed in the surface (19, 27) of the plate-like appendage of the tool (4, 5). In a preferred embodiment, the toolhead is constituted by a folded sheet-metal blank and provides for the use of two tools, the plate-like appendages of which engage in opposite ends of the slot and have complementarily-stepped ends (21, 29) which contact each other.

4 Claims, 3 Drawing Figures

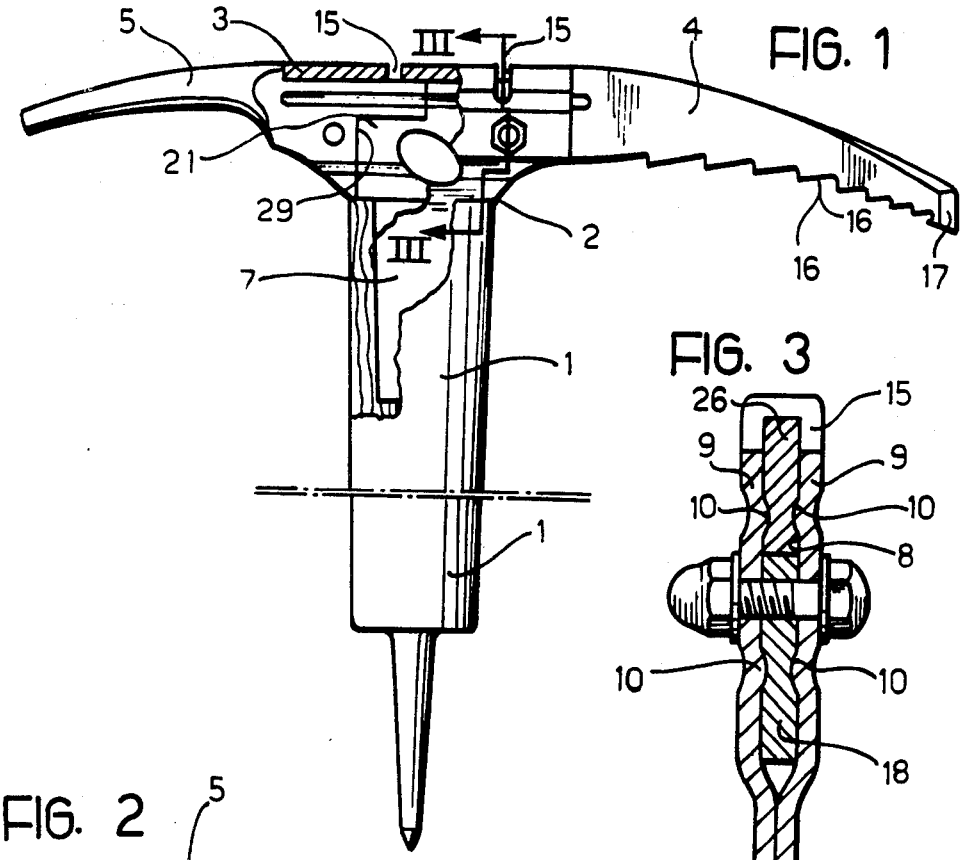
FIG. 1
FIG. 3
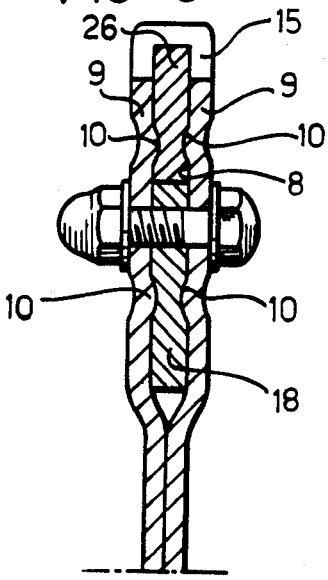
FIG. 2
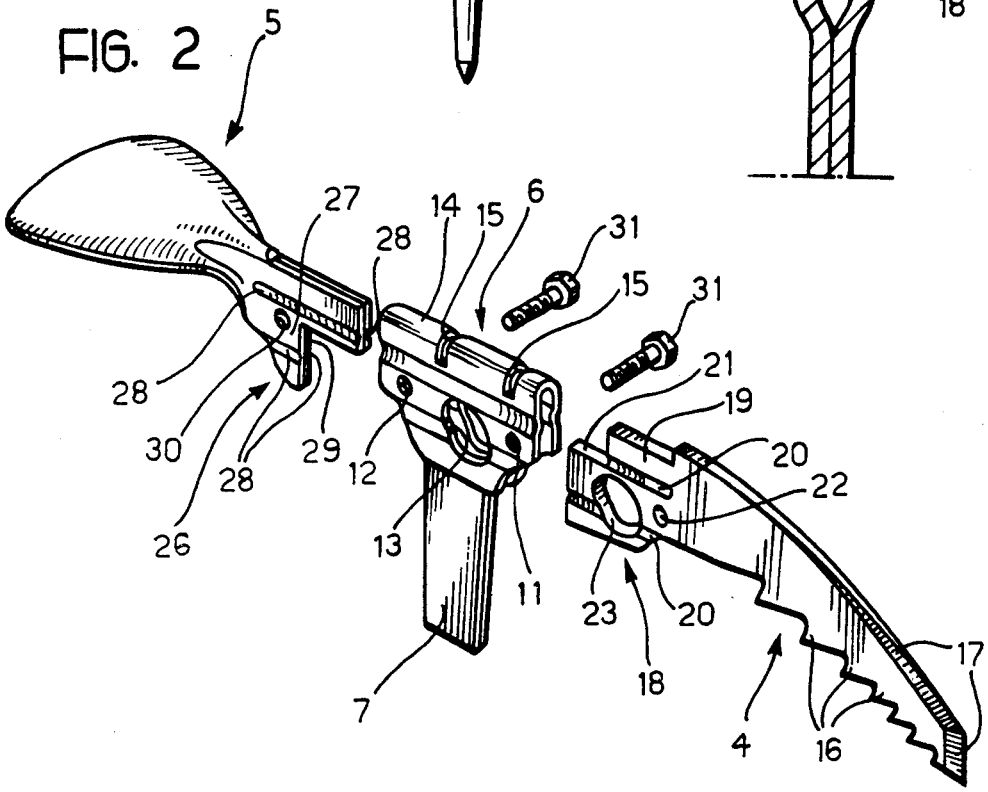

MOUNTAINEERING IMPLEMENT

The present invention relates to mountaineering implements comprising a handle, a toolhead mounted at the end of the handle and at least on tool releasably fixed to the tool head.

Mountaineering implements of the type mentioned above are known in which the tools are fixed to the toolhead by screw means so that nearly all the forces exerted on the tools are discharged on the toolhead through the screw means. Consequently, the high stress concentrations to which the screw means are subject may cause their deformation, rendering the subsequent dismantling of the tools during replacement difficult.

Moreover, the toolhead and the tools are made by casting and forgoing, which involves high manufacturing costs.

The object of the present invention is to provide a mountaineering implement of the type defined above which eliminates the disadvantages described above.

In order to achieve this object, the present invention provides a mountaineering implement of the type described above, characterised in that the toolhead has a slot, the tool has a plate-like appendage slidably inserted and locked in the slot, and in that the slot has two opposing flat faces each having at least one rib extending parallel to the direction of sliding of the plate-like appendage in the slot, each rib being engaged in a corresponding groove formed in the surface of the plate-like appendage of the tool, and in that the said toolhead is constituted by a folded sheet-metal blank.

The mountaineering implement according to the invention has the advantage that nearly all the forces which arise during use of the tools are discharged on the toolhead through the grooves engaged with the corresponding ribs. The extent and the solidity of the coupling between the toolhead and the tool reduce the stresses to which the coupling itself is subject and allow much greater forces to be exerted on the tool without jeopardising or forcing the connection between the toolhead and the tool so that subsequent dismantling is easy.

Moreover the mountaineering implement according to the present invention, being formed by blanking and folding of sheet metal, allows considerable economy to be achieved in its manufacture in an industrial production line.

Further characteristics and advantages of the present invention will emerge from the following description, with reference to the appended drawings given purely by way of non-limiting example, in which:

FIG. 1 is a partially sectioned view of a pickaxe according to the present invention;

FIG. 2 is an exploded view of a detail of FIG. 1; and

FIG. 3 is a sectional view, taken on line III—III of FIG. 1, on an enlarged scale.

In FIG. 1 the handle of a pickaxe is indicated by 1. At one end 2 of the pickaxe 1 is mounted a toolhead 3 to which two tools 4, 5 are fixed.

The toolhead 3, see FIG. 2, comprises a flat body 6 from which a tang 7 extends downwardly for insertion in the handle 1 of the pickaxe. The toolhead 3 is constituted by a single element of blanked, folded sheet metal. The end portions of this element mate with each other so as to form the tang 7 while the central, folded part defines a longitudinal slot 8 which extends through the body 6 of the toolhead 3. The two walls, indicated by reference numeral 9, which define the sides of the slit 8 each have two ribs extending parallel to the direction of sliding of the tools in the slot 8 during assembly thereof.

11 and 12 indicate two circular holes formed in the walls 9 of the toolhead 3 while 13 indicates a substantially-elliptical through-hole provided for the passage of a safety cord.

The upper surface 14 of the body 6 is formed with two notches 15 for weight-reducing and aesthetic purposes.

The tool shown as 4 is in the form of a bill provided with a toothed, lower edge 16 and sharp, upper and front surfaces 17. From the rear part of the tool 4 extends a plate-like appendage 18 having two flat surfaces 19 each of which is provided with two grooves 20 which complement the ribs 10. The appendage 18 has a stepped end edge 21 and two through-holes 22, 23 of sizes and shapes corresponding to those of the holes 11 and 13 respectively.

The tool 5 shown is in the form of a hoe provided with a plate-like appendage 26 with two flat surfaces 27 in each of which are formed two grooves 28 which complement the ribs 10.

The end edge 29 of the appendage 26 is stepped and complements the end 21 of the appendage 18; this allows some of the forces which originate at one tool to be discharged on the other tool, so that they are shared over the entire length of the coupling between the grooves 20, 28 and the ribs 10. Thus the stresses to which the coupling itself is subject are reduced.

The appendage 26 also has a through-hole 30 of a shape corresponding to that of the hole 12.

Two bolts engaged in the holes 11, 22 and 12, 30 for locking the tools 4 and 5 respectively to the toolhead 3 are shown as 31.

Naturally these bolts may be replaced by other known types of locking means for the tools.

In order to replace the tools of the pickaxe according to the invention, it suffices to unscrew the bolts 31 and remove them, after which it is possible to withdraw the tools from the toolhead and to insert the new tools to be used; finally, these new tools are locked in place by reinserting and doing up the bolts 31.

Naturally the tools may have forms different from the bill and hoe types described above; more particularly, the tools may be in the form of a hammer, spade, scoop, saw, adze or other form which can give the tool itself a particular utility.

What is claimed is:

1. Mountaineering implement comprising a handle, a toolhead mounted at one end of the handle and a pair of tools releasably fixed to said toolhead, wherein:

said toolhead comprises a folded sheet-metal blank including two spaced-apart wall portions defining between them an elongate slot open at both ends;

each of said tools has a plate-like appendage slidably engaged in said slot through a respective one of said open ends;

said wall portions each have at least one rib projecting into said slot and extending parallel to the direction of sliding of said appendages in said slot, each of said appendages has grooves in opposing surfaces thereof which receive said ribs to allow said sliding, and said appendages have complementarily stepped edge portions which contact each other when said appendages are received in said slot; and releasable locking means locking said appendages in said slot.

2. Mountaineering implement as claimed in claim 1, wherein said wall portions and said plate-like appendages have corresponding apertures and each of said locking means comprises a bolt passed through said apertures and retained by a nut.

3. Mountaineering implement as claimed in claim 1, wherein each stepped end of a said appendage has edge portions parallel to the grooves in said appendage alternating with edge portions perpendicular to said grooves.

4. Mountaineering implement as claimed in claim 1, wherein each wall portion has two said ribs cooperating with two said grooves.

* * * * *